US011879231B2

(12) United States Patent
Kean et al.

(10) Patent No.: US 11,879,231 B2
(45) Date of Patent: Jan. 23, 2024

(54) SYSTEM AND METHOD OF SELECTIVE AUTOMATION OF LOADING OPERATION STAGES FOR SELF-PROPELLED WORK VEHICLES

(71) Applicant: Deere & Company, Moline, IL (US)

(72) Inventors: Michael G. Kean, Maquoketa, IA (US); Nathaniel M. Czarnecki, Dubuque, IA (US); Ryan Stumvoll, Dubuque, IA (US)

(73) Assignee: Deere & Company, Moline, IL (US)

( * ) Notice: Subject to any disclaimer, the term of this patent is extended or adjusted under 35 U.S.C. 154(b) by 369 days.

(21) Appl. No.: 17/233,623

(22) Filed: Apr. 19, 2021

(65) Prior Publication Data

US 2022/0333344 A1 Oct. 20, 2022

(51) Int. Cl.
*E02F 9/20* (2006.01)
*E02F 9/26* (2006.01)

(52) U.S. Cl.
CPC ..... *E02F 9/2029* (2013.01); *E02F 9/2041* (2013.01); *E02F 9/262* (2013.01); *E02F 9/265* (2013.01)

(58) Field of Classification Search
CPC ..... E02F 9/2029; E02F 9/2041; E02F 9/262; E02F 9/265; E02F 9/2037; E02F 9/264; E02F 3/439; E02F 3/434
See application file for complete search history.

(56) References Cited

U.S. PATENT DOCUMENTS 6,157,889 A 12/2000 Baker
7,671,725 B2 3/2010 Tsuji et al.
8,954,252 B1 2/2015 Urmson et al.
9,587,369 B2 3/2017 Fletcher et al.
9,712,791 B2 7/2017 Kim et al.
9,908,385 B2 3/2018 Chundrlik, Jr. et al.
(Continued)

FOREIGN PATENT DOCUMENTS

DE 19858401 A1 9/1999
EP 3445918 B1 10/2021

OTHER PUBLICATIONS

German Search Report issued in application No. DE102022202296.3 dated Dec. 16, 2022 (10 pages).

*Primary Examiner* — Russell Frejd
(74) *Attorney, Agent, or Firm* — Gary L. Montle; Lucian Wayne Beavers; Patterson Intellectual Property Law, PC

(57) ABSTRACT

A method is disclosed for controlled loading by a self-propelled work vehicle comprising ground engaging units supporting a main frame, and at least one work attachment moveable with respect to the main frame for loading and unloading material in a loading area external to the work vehicle. Using at least one detector, such as cameras and/or vehicle motion sensors, location inputs for the loading area are detected respective to the main frame and/or at least one work attachment. A trigger input is detected in association with transition of the work vehicle from a first work state to an automated second work state. In the second work state, at least movement of the main frame and/or the at least one work attachment is automatically controlled relative to a defined reference associated with the loading area. Such a system and method facilitates loading operations and accordingly higher productivity regardless of operator experience.

18 Claims, 6 Drawing Sheets

(56) References Cited

U.S. PATENT DOCUMENTS

| | | | | |
|---|---|---|---|---|
| 9,946,451 | B2 | 4/2018 | Kim et al. | |
| 10,479,354 | B2 | 11/2019 | Posselius et al. | |
| 10,815,640 | B2 | 10/2020 | Naito | |
| 10,831,213 | B2 | 11/2020 | Kean et al. | |
| 2012/0136509 | A1* | 5/2012 | Everett | E02F 9/2054 701/2 |
| 2014/0222247 | A1* | 8/2014 | Friend | G05D 1/0276 701/2 |
| 2015/0189216 | A1 | 7/2015 | Fukuchi et al. | |
| 2015/0308070 | A1 | 10/2015 | Deines | |
| 2017/0017239 | A1* | 1/2017 | Kanai | G08G 1/207 |
| 2017/0073925 | A1* | 3/2017 | Friend | E02F 9/261 |
| 2017/0103580 | A1 | 4/2017 | Petrany et al. | |
| 2017/0131722 | A1 | 5/2017 | Hiramatsu et al. | |
| 2017/0135277 | A1 | 5/2017 | Hiramatsu et al. | |
| 2017/0220044 | A1* | 8/2017 | Sakai | G05D 1/0219 |
| 2017/0278395 | A1* | 9/2017 | Hamada | G08G 1/015 |
| 2018/0035050 | A1 | 2/2018 | Lu et al. | |
| 2018/0080193 | A1 | 3/2018 | Myers | |
| 2018/0142441 | A1 | 5/2018 | Berry et al. | |
| 2019/0146513 | A1* | 5/2019 | Tomita | A01B 69/008 701/50 |
| 2019/0176621 | A1* | 6/2019 | Cardona | B60W 30/18027 |

* cited by examiner

SYSTEM AND METHOD OF SELECTIVE AUTOMATION OF LOADING OPERATION STAGES FOR SELF-PROPELLED WORK VEHICLES

FIELD OF THE DISCLOSURE

The present disclosure relates generally to self-propelled work vehicles, and more particularly to systems and methods for selective automation of vehicle movements and/or work attachment movements during specified portions of loading operations.

BACKGROUND

Self-propelled work vehicles as discussed herein may particularly refer to wheel loaders for illustrative purposes, but may also for example include excavator machines, forestry machines, and other equipment which modify the terrain or equivalent working environment in some way. These work vehicles may have tracked or wheeled ground engaging units supporting the undercarriage from the ground surface, and may further include one or more work attachments which are used to carry material from one location for discharging into a loading area such as for example associated with a truck or hopper.

One of skill in the art will appreciate the persistent challenge in finding experienced operators for certain conventional self-propelled work vehicles. With respect to wheel loaders as exemplary such work vehicles, one particularly challenging portion of the operating cycle for novice operators is that of approaching and loading a loading area such as for example associated with a truck or hopper. Novice operators may typically learn the 'dig' portion of the operating cycle relatively quickly but will often continue for some time to be hesitant when approaching a truck or hopper.

As one example, an operation for discharging bulk material from the attachment (e.g., bucket) of the work vehicle may include pivoting movements of the attachment relative to the main frame of the work vehicle and to the loading area, and further includes movement of the work vehicle itself relative to the ground and to the loading area. Accordingly, care must be taken that the attachment and/or other portions of the work vehicle do not collide with the loading area during the discharging operation, which may include not only an approach by the attachment to the loading area but also a withdrawal of the attachment after the discharge of bulk material is complete.

In addition, the work vehicle operator often cannot accurately estimate an appropriate weight of bulk material for a specific loading area (e.g., associated with a transport vehicle) or an appropriate bulk material arrangement/height with respect to the loading area. An excessively high load may for example affect traffic safety, and an excessively low load is economically disadvantageous. Accordingly, it would be desirable if care could further be taken to arrange the discharge of bulk material and/or correct the distribution of bulk material in the loading area to arrive at a maximum load without adverse effects on traffic safety.

BRIEF SUMMARY

The current disclosure provides an enhancement to conventional systems, at least in part by introducing a novel system and method for a selective loading assist feature.

One exemplary objective of such a loading assist feature may be to add value to a customer by automating aspects of a truck loading operation related to controlling attachment (e.g., boom) motion and work vehicle stopping distance with respect to the truck. Referring to a wheel loader application for illustrative purposes, a system and method as disclosed herein may for example use a stereo camera to identify and measure the distance from the wheel loader to a truck or hopper. When an operator triggers the feature, using for example an existing interface tool such as the boom height kick out detent, the feature may automatically engage and subsequently synchronize the motion of the boom and wheels so that the boom arrives at the correct height as the loader reaches the truck.

The system and method as disclosed herein may also limit drivetrain motion so that the loader comes to a smooth stop just at the correct distance to dump in the truck.

Once the approach to the truck has been accomplished other aspects of the dump cycle as further disclosed herein may also be automated for additional value.

Accordingly, a system and method as disclosed herein may provide site owners with increased confidence that even a new operator will not contact the truck bed or hopper with the loader bucket when loading it.

A system and method as disclosed herein may further facilitate the loading operations for novice operators, who may only need to drive up to the truck with the linkage and stopping distance automated for them, Site owners may further desirably experience a higher and consistent productivity regardless of the experience level of equipment operators.

In one embodiment, a computer-implemented method as disclosed herein is provided for controlled loading by a self-propelled work vehicle comprising a plurality of ground engaging units supporting a main frame, and at least one work attachment moveable with respect to the main frame and configured for loading and unloading material in a loading area external to the work vehicle. One or more location inputs for the loading area detected, via at least one detector associated with the work vehicle, respective to the main frame and/or at least one work attachment. A trigger input is detected in association with transition of the work vehicle from a first work state to an automated second work state. In the second work state, at least movement of the main frame and/or the at least one work attachment is automatically controlled relative to a defined reference associated with the loading area.

In one exemplary aspect according to the above-referenced embodiment, the detecting of one or more location inputs may comprise capturing images via an imaging device and detecting loading area parameters from the captured images.

The detected loading area parameters may further comprise one or more contours of the loading area and any one or more objects corresponding to material currently loaded in the loading area.

The detected loading area parameters may still further comprise a distribution of material currently loaded in the loading area, the method in the second work state further comprising automatically controlling at least movement of the main frame and/or the at least one work attachment to unload material in the loading area in accordance with the detected distribution of material.

In another exemplary aspect according to the above-referenced embodiment, the method may in the second work state further comprise comparing the detected distribution of material to a target loading profile, and based on said comparison selectively controlling at least movement of the main frame and/or the at least one work attachment in a trajectory across a reference plane associated with the loading area.

In another exemplary aspect according to the above-referenced embodiment, the loading area may be associated with a loading vehicle. The target loading profile may further be determined in association with identified locations of the one or more loading vehicle tires and/or loading vehicle axles.

In another exemplary aspect according to the above-referenced embodiment, the at least one detector may further comprise a vehicle motion sensor.

In another exemplary aspect according to the above-referenced embodiment, the method may further comprise determining that new inputs from the imaging device are unavailable, and estimating a current position of the loading area respective to the main frame and/or at least one work attachment based on at least inputs from the vehicle motion sensor and a last input from the imaging device.

In another exemplary aspect according to the above-referenced embodiment, the location inputs for the loading area may correspond to one or more of: a distance between the loading area and the main frame; a distance between the loading area and the at least one work attachment; a height of a material receiving portion of the loading area; and an orientation of the loading area respective to the main frame and/or at least one work attachment.

In another exemplary aspect according to the above-referenced embodiment, the trigger input may comprise a manually activated signal via a user interface.

In another exemplary aspect according to the above-referenced embodiment, the trigger input may be automatically detected based on identified threshold conditions corresponding to one or more of: a position of the at least one work attachment respective to the main frame; a distance between the loading area and the main frame; and a distance between the loading area and the at least one work attachment.

In another exemplary aspect according to the above-referenced embodiment, the method may in the second work state further comprise determining a first trajectory for movement of the plurality of ground engaging units from a current work vehicle speed to a stopped work vehicle speed in association with the defined reference associated with the loading area, determining a second trajectory for movement of one or more of the at least one work attachment from a current work attachment position to an unloading position at the stopped work vehicle speed, and automatically controlling the movement of the plurality of ground engaging units in accordance with the first trajectory and the movement of the one or more of the at least one work attachment in accordance with the second trajectory.

The second trajectory may be determined in part based on a detected height of the loading area.

The second trajectory may further or in the alternative be determined based on a detected profile of material previously loaded in the loading area.

In another exemplary aspect according to the above-referenced embodiment, the method may further comprise detecting a second trigger input associated with completion of the second work state and transition of the work vehicle to an automated third work state. In the third work state, at least movement of the main frame and/or the at least one work attachment may be automatically controlled to move away from, and avoid contact with, the loading area.

The method may further comprise, in the third work state, controlling at least movement of the at least one work attachment for further transition to the first work state.

In another embodiment as disclosed herein, a self-propelled work vehicle comprises a plurality of ground engaging units supporting a main frame, at least one work attachment moveable with respect to the main frame and configured for loading and unloading material in a loading area external to the work vehicle, and at least one detector configured to detect one or more location inputs for the loading area respective to the main frame and/or at least one work attachment.

A controller is further provided and configured to detect a trigger input associated with transition of the work vehicle from a first work state to an automated second work state, and in the second work state, to automatically control at least movement of the main frame and/or the at least one work attachment relative to a defined reference associated with the loading area.

The controller may be further optionally configured to direct the performance of steps according to some or all of the associated exemplary aspects.

Numerous objects, features and advantages of the embodiments set forth herein will be readily apparent to those skilled in the art upon reading of the following disclosure when taken in conjunction with the accompanying drawings.

DETAILED DESCRIPTION

Figure 1:
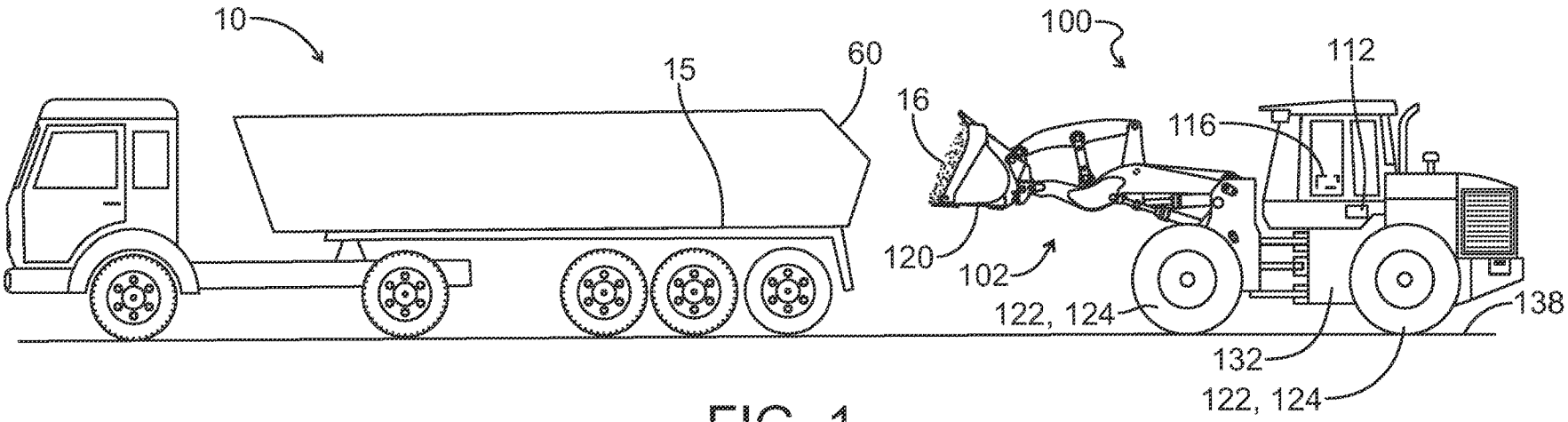
FIG. 1 is a side view of an exemplary embodiment of a self-propelled work vehicle and loading area according to the present disclosure.
Figure 2:
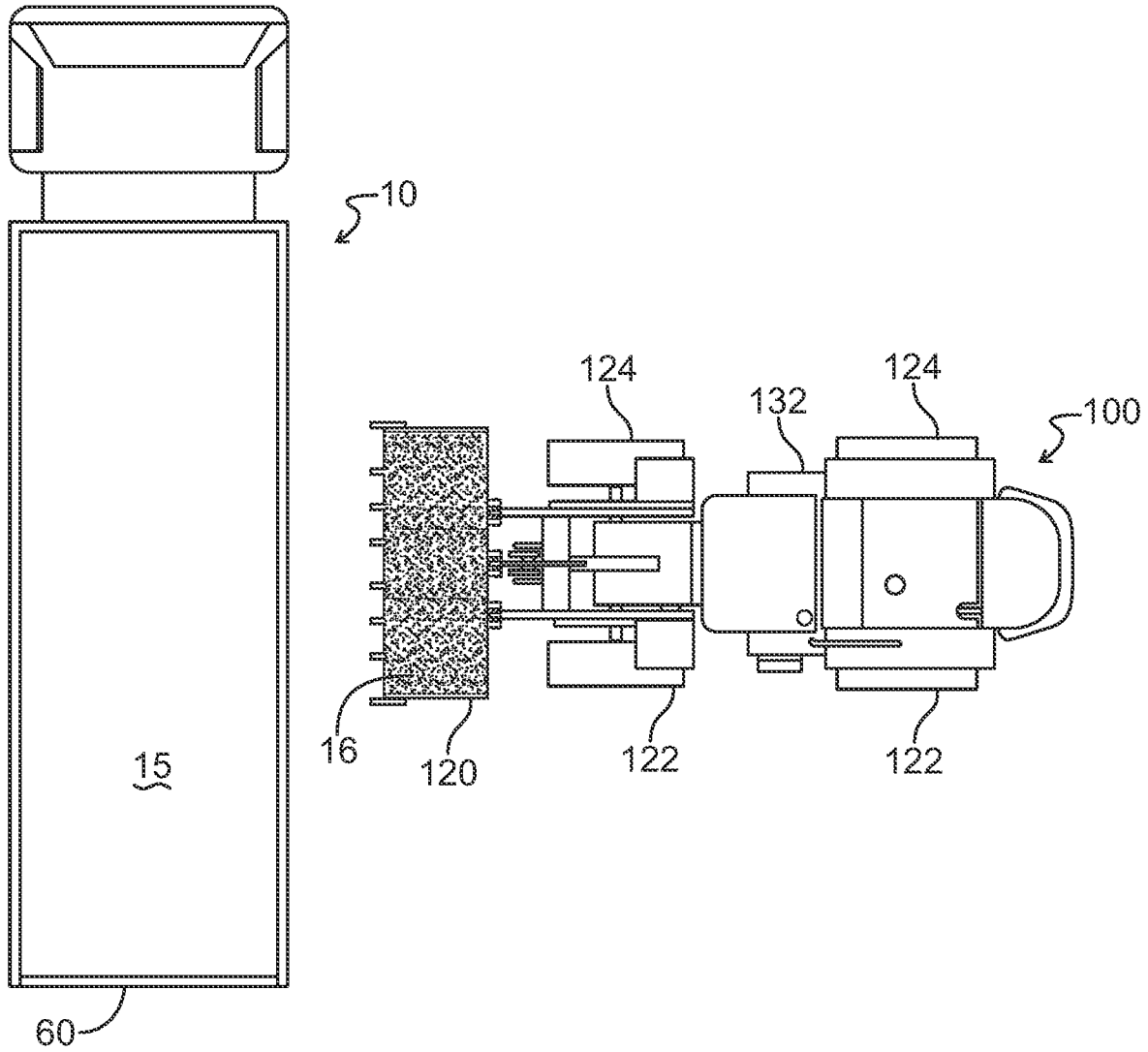
FIG. 2 is an overhead view of the self-propelled work vehicle of FIG. 1, approaching the loading area from the side.

Referring now to FIGS. 1-6, various embodiments may now be described of an inventive system and method.

FIGS. 1-4 in a particular embodiment as disclosed herein show a representative self-propelled work vehicle 100 in the form of, for example, a loader having a front-mounted work attachment 120 for modifying the proximate terrain. It is within the scope of the present disclosure that the work vehicle 100 may be in the form of any other self-propelled vehicle using a work attachment to modify the proximate terrain and to carry material from the terrain for loading into a loading area 10, and generally designed for use in off-highway environments such as a construction or forestry vehicle, for example. In the embodiment shown, the loading area 10 is associated with a truck and typically includes a loading surface 15 surrounded by a plurality of walls 60 and an open area opposite the base to accommodate the discharge of material 16 thereinto.

The illustrated work vehicle 100 includes a main frame 132 supported by a first pair of wheels as left-side ground engaging units 122 and a second pair of wheels as right-side ground engaging units 124, and at least one travel motor (not shown) for driving the ground engaging units.

The work attachment 120 for the illustrated self-propelled work vehicle 100 comprises a front-mounted loader bucket 120 coupled to a boom assembly 102. The loader bucket 120 faces generally away from the operator of the loader 100 and is moveably coupled to the main frame 132 via the boom assembly 102 for forward-scooping, carrying, and dumping dirt and other materials for example into a loading area 10 such as associated with an articulated dump truck. In an alternative embodiment wherein the self-propelled work vehicle is for example a tracked excavator, the boom assembly 102 may be defined as including at least a boom and an arm pivotally connected to the boom. The boom in the present example is pivotally attached to the main frame 132 to pivot about a generally horizontal axis relative to the main frame 132. A coupling mechanism may be provided at the end of the boom assembly 102 and configured for coupling to the work attachment 120, which may also be characterized as a working tool, and in various embodiments the boom assembly 102 may be configured for engaging and securing various types and/or sizes of attachment implements 120.

In other embodiments, depending for example on the type of self-propelled work vehicle 100, the work attachment 120 may take other appropriate forms as understood by one of skill in the art, but for the purposes of the present disclosure will comprise work attachments 120 for carrying material from a first location for discharging or otherwise unloading into a second location as a loading area (e.g., a truck or hopper).

An operator's cab may be located on the main frame 132. The operator's cab and the boom assembly 102 (or the work attachment 120 directly, depending on the type of work vehicle 100) may both be mounted on the main frame 132 so that the operator's cab faces in the working direction of the work attachments 120. A control station including a user interface 116 may be located in the operator's cab. As used herein, directions with regard to work vehicle 100 may be referred to from the perspective of an operator seated within the operator cab; the left of the work vehicle is to the left of such an operator, the right of the work vehicle is to the right of such an operator, a front-end portion (or fore) of the work vehicle is the direction such an operator faces, a rear-end portion (or aft) of the work vehicle is behind such an operator, a top of the work vehicle is above such an operator, and a bottom of the work vehicle below such an operator.

A user interface 116 as described herein may be provided as part of a display unit configured to graphically display indicia, data, and other information, and in some embodiments may further provide other outputs from the system such as indicator lights, audible alerts, and the like. The user interface may further or alternatively include various controls or user inputs (e.g., a steering wheel, joysticks, levers, buttons) 208 for operating the work vehicle 100, including operation of the engine, hydraulic cylinders, and the like. Such an onboard user interface may be coupled to a vehicle control system via for example a CAN bus arrangement or other equivalent forms of electrical and/or electro-mechanical signal transmission. Another form of user interface (not shown) may take the form of a display unit that is generated on a remote (i.e., not onboard) computing device, which may display outputs such as status indications and/or otherwise enable user interaction such as the providing of inputs to the system. In the context of a remote user interface, data transmission between for example the vehicle control system and the user interface may take the form of a wireless communications system and associated components as are conventionally known in the art.

Figure 5:
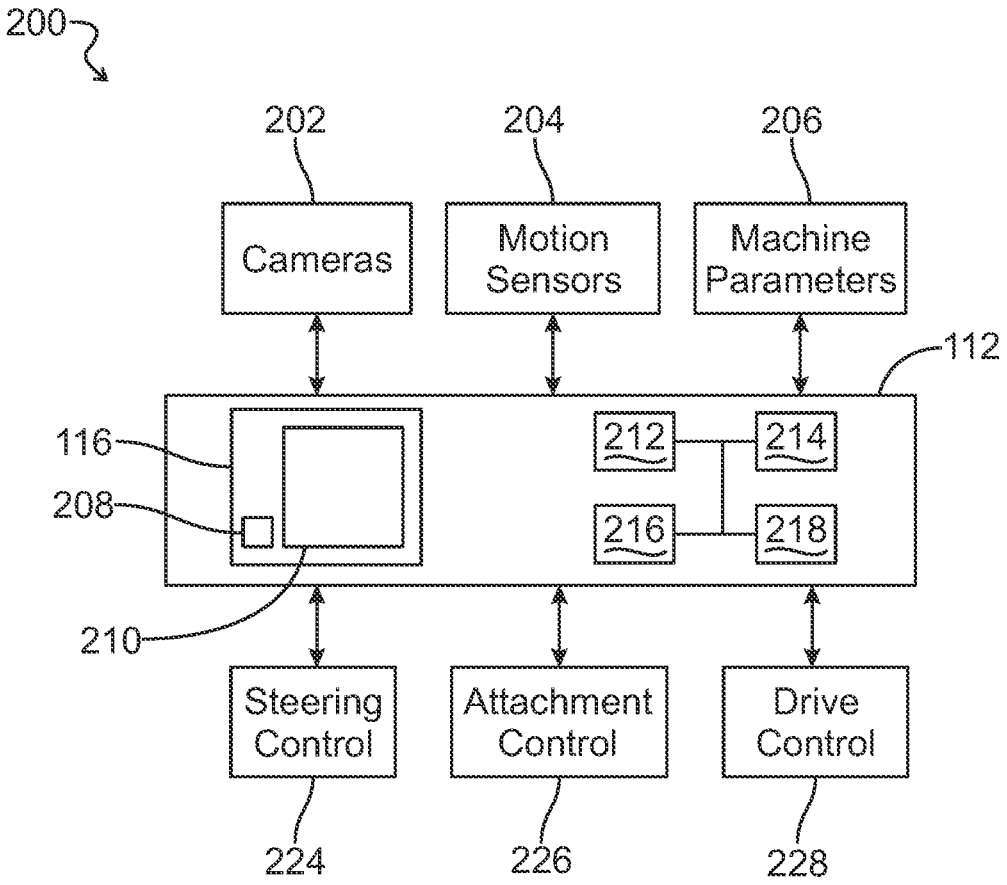
FIG. 5 is a block diagram representing a control system according to an embodiment of the present disclosure.

As also schematically illustrated in FIG. 5, the work vehicle 100 includes a control system 200 including a controller 112. The controller 112 may be part of the machine control system of the work vehicle, or it may be a separate control module. The controller 112 may include the user interface 116 and optionally be mounted in the operator cab at a control panel.

The controller 112 is configured to receive inputs from some or all of various sources such as a camera system 202, work vehicle motion sensors 204, and machine parameters 206 such as for example from the user interface and/or a machine control system for the work vehicle if separately defined with respect to the controller.

The camera system 202 is appropriate embodiments may comprise one or more imaging devices such as cameras 202 mounted on the self-propelled work vehicle 100 and arranged to capture images corresponding to surroundings of the self-propelled work vehicle 100. The camera system 202 may include video cameras configured to record an original image stream and transmit corresponding data to the controller 112. In the alternative or in addition, the camera system 202 may include one or more of an infrared camera, a stereoscopic camera, a PMD camera, or the like. The number and orientation of said cameras may vary in accordance with the type of work vehicle and relevant applications, but may at least be provided with respect to an area in a travelling direction of the work vehicle and configured to capture images associated with a loading area 10 toward which the work vehicle is travelling. The position and size of an image region recorded by a respective camera 202 may depend on the arrangement and orientation of the camera and the camera lens system, in particular the focal length of the lens of the camera, but may desirably be configured to capture substantially the entire loading area 10 throughout an approach and withdrawal of the work vehicle and the associated attachment during a loading operation.

An exemplary work vehicle motion sensing system 204 may include inertial measurement units (IMUs) mounted to respective components of the work attachment 120 and/or boom assembly 102 and/or main frame 132, sensors coupled to piston-cylinder units to detect the relative hydraulically actuated extensions thereof, or any known alternatives as may be known to those of skill in the art.

In various embodiments, additional sensors may be provided to detect machine operating conditions or positioning, including for example an orientation sensor, global positioning system (GPS) sensors, vehicle speed sensors, vehicle implement positioning sensors, and the like, and whereas one or more of these sensors may be discrete in nature the sensor system may further refer to signals provided from the machine control system.

In an embodiment, any of the aforementioned sensors may be supplemented using radio frequency identification (RFID) devices or equivalent wireless transceivers on one or more attachments, the loading area, and the like. Such devices may for example be implemented to determine and/or confirm a distance and/or orientation there between.

Other sensors (not shown) may collectively define an obstacle detection system, alone or in combination with one or more aforementioned sensors for improved data collection, various examples of which may include ultrasonic sensors, laser scanners, radar wave transmitters and receivers, thermal sensors, imaging devices, structured light sensors, other optical sensors, and the like. The types and combinations of sensors for obstacle detection may vary for a type of work vehicle, work area, and/or application, but generally may be provided and configured to optimize recognition of objects proximate to, or otherwise in association with, a determined working area of the vehicle and/or associated loading area for a given application.

The controller 112 may typically coordinate with the above-referenced user interface 116 for the display of various indicia to the human operator. The controller may further generate control signals for controlling the operation of respective actuators, or signals for indirect control via intermediate control units, associated with a machine steering control system 224, a machine attachment control system 226, and/or a machine drive control system 228. The controller 112 may for example generate control signals for controlling the operation of various actuators, such as hydraulic motors or hydraulic piston-cylinder units, and electronic control signals from the controller 112 may actually be received by electro-hydraulic control valves associated with the actuators such that the electro-hydraulic control valves will control the flow of hydraulic fluid to and from the respective hydraulic actuators to control the actuation thereof in response to the control signal from the controller 112. The controller 112 further communicatively coupled to a hydraulic system as machine attachment control system 226 may accordingly be configured to operate the work vehicle 100 and operate an attachment 120 coupled thereto, including, without limitation, the attachment's lift mechanism, tilt mechanism, roll mechanism, pitch mechanism and/or auxiliary mechanisms, for example and as relevant for a given type of attachment or work vehicle application. The controller 202 further communicatively coupled to a hydraulic system as machine steering control system 224 and/or machine drive control system 228 may be configured for moving the work vehicle in forward and reverse directions, moving the work vehicle left and right, controlling the speed of the work vehicle's travel, etc.

The controller 112 includes or may be associated with a processor 212, a computer readable medium 214, a communication unit 216, data storage 218 such as for example a database network, and the aforementioned user interface 116 or control panel having a display 210. An input/output device 208, such as a keyboard, joystick or other user interface tool, is provided so that the human operator may input instructions to the controller 112. It is understood that the controller 112 described herein may be a single controller having all of the described functionality, or it may include multiple controllers wherein the described functionality is distributed among the multiple controllers.

Various operations, steps or algorithms as described in connection with the controller 112 can be embodied directly in hardware, in a computer program product such as a software module executed by the processor 212, or in a combination of the two. The computer program product can reside in RAM memory, flash memory, ROM memory, EPROM memory, EEPROM memory, registers, hard disk, a removable disk, or any other form of computer-readable medium 214 known in the art. An exemplary computer-readable medium 214 can be coupled to the processor 212 such that the processor 212 can read information from, and write information to, the memory/storage medium 214. In the alternative, the medium 214 can be integral to the processor 212. The processor 212 and the medium 214 can reside in an application specific integrated circuit (ASIC). The ASIC can reside in a user terminal. In the alternative, the processor 212 and the medium 214 can reside as discrete components in a user terminal.

The term "processor" 212 as used herein may refer to at least general-purpose or specific-purpose processing devices and/or logic as may be understood by one of skill in the art, including but not limited to a microprocessor, a microcontroller, a state machine, and the like. A processor 212 can also be implemented as a combination of computing devices, e.g., a combination of a DSP and a microprocessor, a plurality of microprocessors, one or more microprocessors in conjunction with a DSP core, or any other such configuration.

The communication unit 216 may support or provide communications between the controller 112 and external systems or devices, and/or support or provide communication interface with respect to internal components of the self-propelled work vehicle 100. The communications unit may include wireless communication system components (e.g., via cellular modem, WiFi, Bluetooth or the like) and/or may include one or more wired communications terminals such as universal serial bus ports.

The data storage 218 as discussed herein may, unless otherwise stated, generally encompass hardware such as volatile or non-volatile storage devices, drives, memory, or other storage media, as well as one or more databases residing thereon.

Figure 6:
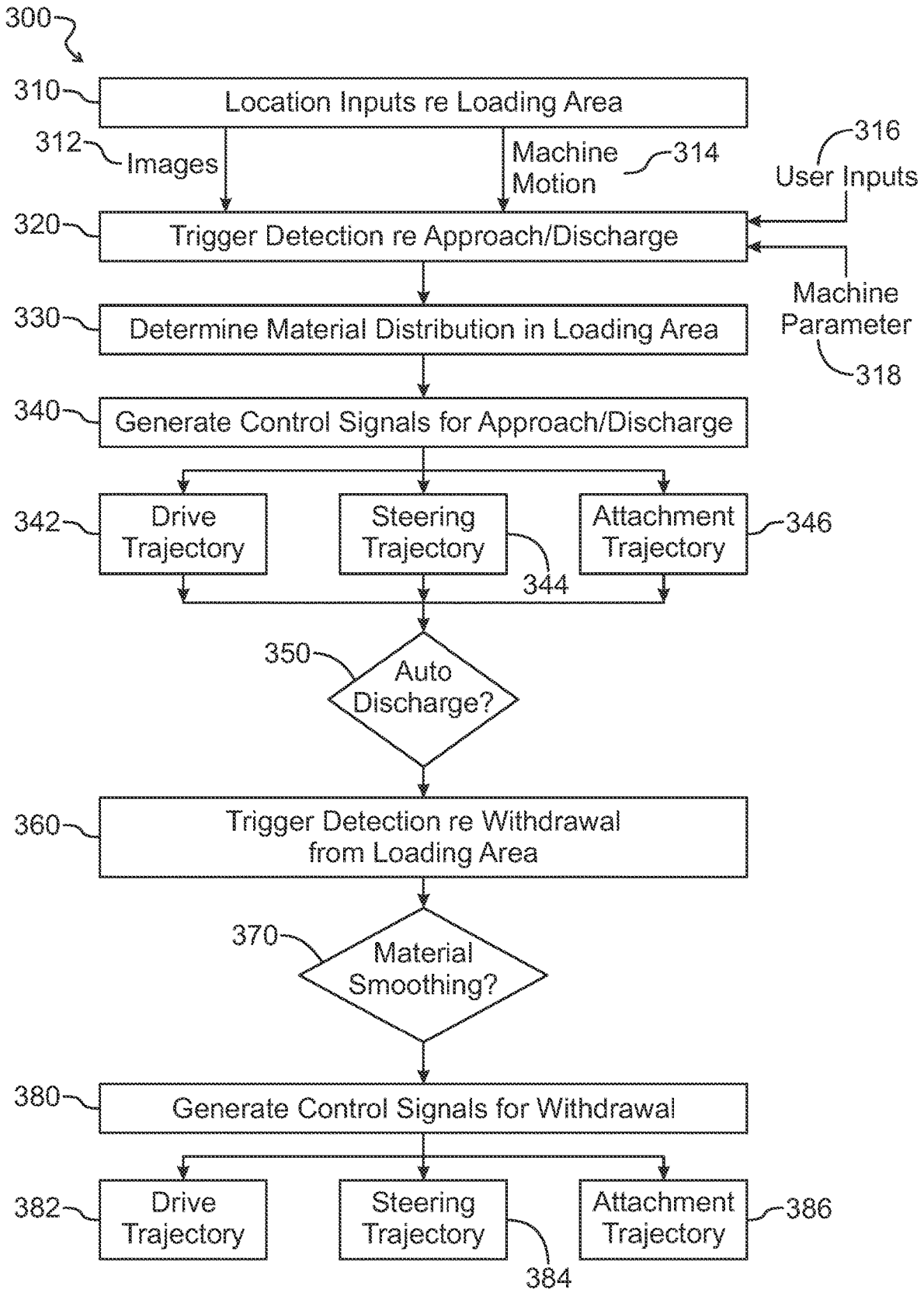
FIG. 6 is a flowchart representing an exemplary method according to an embodiment of the present disclosure.

Referring next to FIG. 6, an embodiment method 300 may now be described which is exemplary but not limiting on the scope the present disclosure unless otherwise specifically noted. One of skill in the art may appreciate that alternative embodiments may include fewer or additional steps, and that certain disclosed steps may for example be performed in different chronological order or simultaneously.

In initial exemplary steps, the method 300 includes collecting location inputs (step 310) such as captured images 312 of the loading area 10 and optionally supplemented with sensed motion 314 of the work vehicle 100, and further processing said location inputs 310 along with further optional inputs such as user inputs 316 via a user interface and/or work vehicle operating parameters 318 to detect whether an automated operation is to be entered. This may entail for example detecting a trigger (step 320) associated with a desired transition from a first work state (e.g., manual approach of the work vehicle and associated attachment) to a second work state (e.g., automation of one or more work vehicle operations including movements of the attachment and/or work vehicle). Sensor fusion techniques may for example be implemented to combine image data (e.g., stereo camera measurements) and local vehicle motion measurements to estimate the position of the loading area 10.

In an embodiment, a trigger for initiating or otherwise engaging an automated portion of the method may be an input provided by the user for example using a boom height kick out detent interface tool or other equivalent trigger representative of approach to the loading area 10. The trigger may be predetermined in accordance with an action normally taken by the operator as part of the loading and unloading process. Alternatively, the trigger itself may be automatically provided via monitoring of relationships between a location of the loading area and movements of the work vehicle, for example a threshold distance between components of the loading area and the work vehicle, a determined distance further in view of an orientation and/or movement speed of the components, or the like.

In one embodiment an image processing aspect of the method 300 may include processing of stereo camera disparity measurements and stored or otherwise developed models in order to segment respective measurements into a floor plane associated for example with the loading surface 15 and one or more objects such as for example material 16 residing on the loading surface and/or loading area walls 60, wherein said processing may account for a position, orientation, moving speed, etc., of the camera. Segmentation may in some embodiments be further improved via known indicia (e.g., printed text, barcodes, etc.) associated with the loading area, the attachments, or other objects within the image frame. In embodiments where multiple imaging devices may be utilized, a known relative position and orientation of the imaging devices may further enable object position determination through for example triangulation techniques. Briefly stated, the controller 112 and/or a discrete image processing unit (not shown) may for example utilize conventional image recognition and processing techniques, floor plane modeling, machine learning algorithms, stored loading area data, and the like to analyze the shape and size of an object, to measure a distance to the object from the stereo camera, to identify or predict the extent of the object in the image frame, to measure the orientation of the object in the image frame, and to convert the measurements from the image frame into the work vehicle frame.

As one example, an object (e.g., a component of the loading area) may be extracted from various images via two or more devices in a stereoscopic camera unit, and a distance between said object and the work vehicle 100 determined based on triangulation and/or parallax between the objects in the captured images, and the distance may further be converted to coordinates in the work vehicle frame to determine or estimate a relative position and/or orientation of the object with respect to the work vehicle 100.

The controller 112 may in certain embodiments classify detected objects based for example on its characteristics, image matching, and/or based on stored models or machine learning classifiers that may probabilistically analyze potential object types or characteristics based on the collected images.

The image processing aspect may be configured and utilized in some embodiments for determining a distribution of material in the loading area (step 330).

In an embodiment a motion sensing aspect of the method 300 may include any one or more of various techniques as further discussed herein, for example implementing a sensor fusion algorithm or an equivalent for combining the respective inputs. For example, motion sensing inputs may be provided via tracking local motion of the work vehicle 100 using numerical integration of the ground speed of the vehicle. A work vehicle model may be utilized to predict turn radius. Sensor inputs may be implemented from devices associated with an inertial navigation system (INS) and/or global positioning system (GPS), utilizing monocular camera techniques for visual navigation, or the like.

The illustrated embodiment of the method 300 in FIG. 6 further includes, upon triggering an automated loading feature, generating signals (step 340) for controlling at least an approach of the work vehicle 100 and attachment 120 to the loading area 10, in association with a desired discharge of material 16. This may for example include calculating and implementing a trajectory for the drivetrain 342 beginning at the current work vehicle position and speed and ending in an appropriate position corresponding to the loading area with zero ground speed, using a visual measurement of the location and orientation of the loading area 10 relative to the work vehicle 100 to generate and implement a steering trajectory 344 and dynamically adjust a steering angle of the work vehicle to follow the trajectory as the work vehicle approaches the loading area, and further calculating and implementing a trajectory for one or more attachments (e.g., via the boom cylinder) 346 beginning at the current height and ending at a loading height substantially synchronized with the arrival of the work vehicle relative to the loading area, and/or applying closed loop controls to ensure the boom and drivetrain follow the calculated trajectories.

In an embodiment, the automated loading feature may include calculating a trajectory to automatically adjust a height of an attachment (e.g., the boom lift height) based on visual measurements of the height of the loading area (e.g., truck bed) 10.

In an embodiment the method may further include identifying, based on linkage pose or stereo measurement, when the camera view has been wholly or partially obstructed, for example by the current position of the attachment (e.g., loader bucket) and/or material heaped therein. In such a case, the controller 112 may be configured to use only alternative inputs such as the vehicle motion measurements to estimate a position of the loading area, based for example on vehicle motion since the last valid camera measurement.

The illustrated embodiment of the method 300 further includes, upon completing the trajectory to the loading area, either relinquishing command to the operator or automatically triggering an automatic dumping routine. If a manual discharge is appropriate for the particular application, the method 300 may proceed by monitoring any of one or more inputs 312, 314, 316, 318 for a trigger from the operator, work vehicle operation, or the like associated with transition from the discharge work state to a subsequent work state, such as for example a withdrawal of the work vehicle and attachment from the loading area (step 360). If an automated discharge is to be carried out in response to the query of step 350, the trigger in step 360 may accordingly be automatically detected in view of completion of the discharge routine.

The automated discharge routine may for example include (using for illustrative purposes the context of a loader bucket) shifting of the work vehicle 100 into neutral, automatically dumping the bucket while lifting the boom to prevent the bucket from contacting the loading area, and indicating to the operator that dumping is complete and the work vehicle should be shifted into reverse.

Where the loading area comprises a truck bed as shown in FIGS. 1-4, the controller 112 may be configured with an automated discharge routine to for example include visually identifying the locations of wheels and vehicle axles along the truck and using a load distribution algorithm to modify where the loader dumps in the truck in order to evenly distribute the discharge of successive loader buckets across the truck axles.

Figure 3:
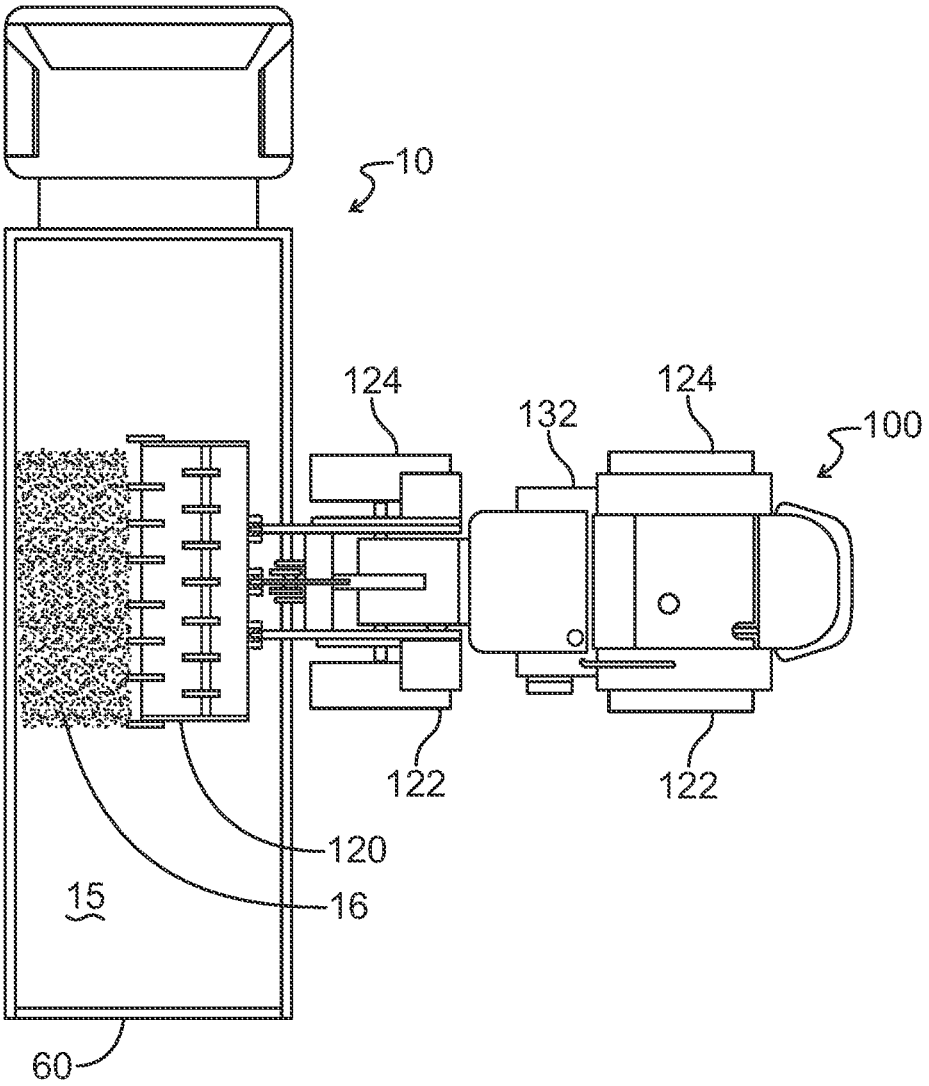
FIG. 3 is the overhead view of the self-propelled work vehicle of FIG. 1, with loaded material in a different portion of the loading area.
Figure 4:
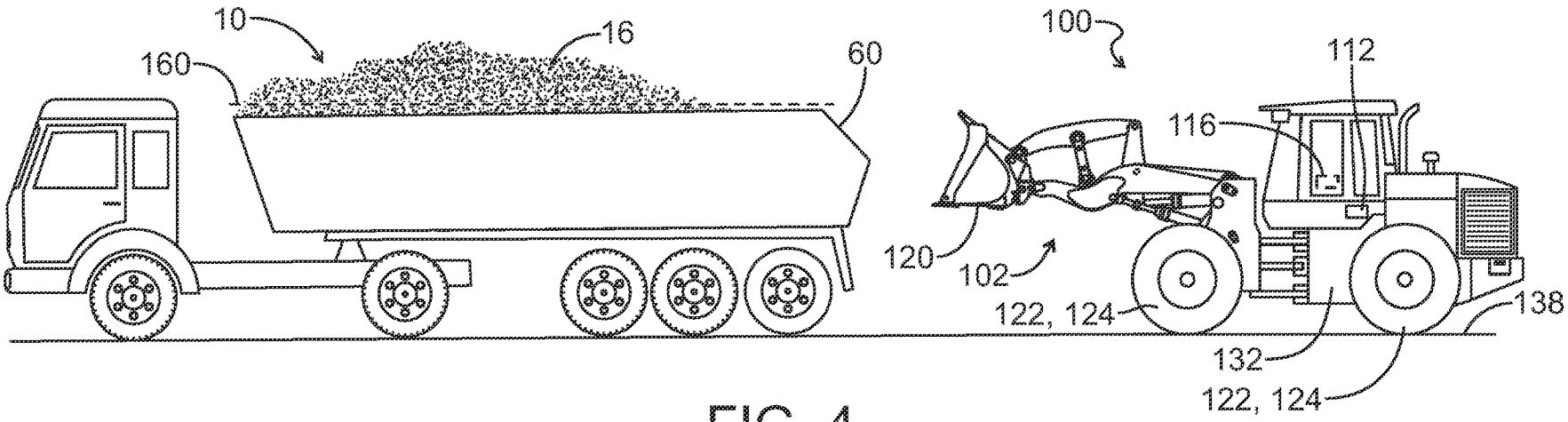
FIG. 4 is the side view of the exemplary embodiment of a self-propelled work vehicle and loading area of FIG. 1, but with an illustrative pile of material extending above a threshold plane associated with the loading area.

In an embodiment the method 300 may further include a subroutine that automatically senses an imbalanced or otherwise inappropriate distribution of bulk material 16 in the loading area 10, and further selectively executes one or more functions for leveling the material in the loading area using for example the cutting edge of the loader bucket as the operator reverses away from the loading area (step 370). For example, the controller 112 may be configured to compare a detected distribution of material to a target loading profile, and based on said comparison to selectively control at least movement of the main frame and/or the at least one work attachment in a trajectory across a reference plane 160 associated with the loading area Referring to FIGS. 2-4, the subroutine may in an embodiment include such a reference plane 160 or an alternative reference as a threshold associated with a bulk material height relative to the walls 60 of the loading area, wherein a violation of the threshold triggers a material smoothing movement prior to withdrawal of the loader bucket. In an embodiment, the subroutine may include a non-threshold based detection of imbalance in the bulk material distribution based on for example comparison of a current distribution with respect to a target distribution of the material, which may be established using a loading routine including a predetermined sequence of loading points within the loading area, a first exemplary point of which is illustrated in FIG. 3. In such a case, the controller 112 may expect to detect bulk material from previous dumping stages in specified portions of the loading area but determine instead that the bulk material is otherwise distributed and accordingly execute a smoothing function to correct for this imbalance.

In the illustrated embodiment of FIG. 6, the method 300 continues, upon a detected trigger such as the operator shifting into reverse, generating control signals associated with withdrawal of the work vehicle and attachment from the loading area (step 380). Such control signals may for example be provided for one or more of controlling the ground speed (step 382) or the steering (step 384) of the loaded as it reverses to prevent the bucket from contacting the loading area 10, controlling the boom and bucket (step 386) to prevent the bucket from contacting the loading area 10 (e.g., truck bed) as the loader reverses from the loading area, and returning the attachment to predetermined positions based on system settings. For example, during an illustrative and non-limiting withdrawal operation the bucket may be directed to a dig or carry position and the boom may be directed to a carry position.

As used herein, the phrase "one or more of," when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item Band item C.

One of skill in the art may appreciate that when an element herein is referred to as being "coupled" to another element, it can be directly connected to the other element or intervening elements may be present.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A computer-implemented method of controlled loading by a self-propelled work vehicle comprising a plurality of ground engaging units supporting a main frame, and at least one work attachment moveable with respect to the main frame and configured for loading and unloading material in a loading area comprising a loading surface surrounded by a plurality of walls, and external to the work vehicle, the method comprising:

detecting, via at least one imaging device associated with the work vehicle, one or more captured images of the loading area respective to the main frame and/or the at least one work attachment;

autonomously detecting one or more visual parameters of the loading area from the captured images;

detecting a trigger input associated with transition of the work vehicle from a first work state to an automated second work state;

in the second work state, automatically controlling at least movement of the main frame and/or the position of the at least one work attachment relative to a defined reference associated with the loading area, using the one or more visual parameters of the loading area to autonomously determine the location of the loading area relative to the main frame or the at least one work attachment.

2. The method of claim 1, wherein the detected visual parameters comprise one or more contours of the loading area and any one or more objects corresponding to material currently loaded in the loading area.

3. The method of claim 2, wherein the detected loading area parameters comprise a distribution of material currently loaded in the loading area, the method in the second work state further comprising automatically controlling at least movement of the main frame and/or the at least one work attachment to unload material in the loading area in accordance with the detected distribution of material.

4. The method of claim 3, further comprising in the second work state comparing the detected distribution of material to a target loading profile and based on said comparison selectively controlling at least movement of the main frame and/or the at least one work attachment in a trajectory across a reference plane associated with the loading area.

5. The method of claim 4, wherein:

the loading area is associated with a loading vehicle;

the target loading profile is determined in association with identified locations of the one or more loading vehicle tires and/or loading vehicle axles.

6. The method of claim 1, wherein the at least one detector further comprises a vehicle motion sensor.

7. The method of claim 6, further comprising:

determining that new inputs from the imaging device are unavailable; and estimating a current position of the loading area respective to the main frame and/or at least one work attachment based on at least inputs from the vehicle motion sensor and a last input from the imaging device.

8. The method of claim 1, wherein the location inputs for the loading area correspond to one or more of: a distance between the loading area and the main frame; a distance between the loading area and the at least one work attachment; a height of a material receiving portion of the loading area; and an orientation of the loading area respective to the main frame and/or at least one work attachment.

9. The method of claim 1, wherein the trigger input comprises a manually activated signal via a user interface.

10. The method of claim 1, wherein the trigger input is automatically detected based on identified threshold conditions corresponding to one or more of: a position of the at least one work attachment respective to the main frame; a distance between the loading area and the main frame; and a distance between the loading area and the at least one work attachment.

11. The method of claim 1, in the second work state comprising:

determining a first trajectory for movement of the plurality of ground engaging units from a current work vehicle speed to a stopped work vehicle speed in association with the defined reference associated with the loading area;

determining a second trajectory for movement of one or more of the at least one work attachment from a current work attachment position to an unloading position at the stopped work vehicle speed; and automatically controlling the movement of the plurality of ground engaging units in accordance with the first trajectory and the movement of the one or more of the at least one work attachment in accordance with the second trajectory.

12. The method of claim 11, wherein the second trajectory is determined in part based on a detected height of the loading area.

13. The method of claim 12, wherein the second trajectory is further determined based on a detected profile of material previously loaded in the loading area.

14. The method of claim 1, comprising:

detecting a second trigger input associated with completion of the second work state and transition of the work vehicle to an automated third work state;

in the third work state, automatically controlling at least movement of the main frame and/or the at least one work attachment to move away from, and avoid contact with, the loading area.

15. The method of claim 14, in the third work state further comprising controlling at least movement of the at least one work attachment for further transition to the first work state.

16. A self-propelled work vehicle comprising:

a plurality of ground engaging units supporting a main frame;

at least one work attachment moveable with respect to the main frame and configured for loading and unloading material in a loading area comprising a loading surface surrounded by a plurality of walls external to the work vehicle;

at least one imaging device configured to autonomously detect one or more visual parameters for the loading area respective to the main frame and/or the at least one work attachment; and a controller configured to detect a trigger input associated with transition of the work vehicle from a first work state to an automated second work state, and in the second work state, automatically control at least movement of the main frame and/or the position of the at least one work attachment relative to a defined reference associated with the loading area using the one or more visual parameters of the loading area to autonomously determine the location of the loading area relative to the main frame or the at least one work attachment.

17. The self-propelled work vehicle of claim 16, wherein the at least one detector further comprises a vehicle motion sensor, and the controller is further configured to:

determine that new inputs from the imaging device are unavailable; and estimate a current position of the loading area respective to the main frame and/or at least one work attachment based on at least inputs from the vehicle motion sensor and a last input from the imaging device.

18. The self-propelled work vehicle of claim 16, wherein:

the controller is configured in the second work state to determine a first trajectory for movement of the plurality of ground engaging units from a current work vehicle speed to a stopped work vehicle speed in association with the defined reference associated with the loading area, determine a second trajectory for movement of one or more of the at least one work attachment from a current work attachment position to an unloading position at the stopped work vehicle speed, and automatically control the movement of the plurality of ground engaging units in accordance with the first trajectory and the movement of the one or more of the at least one work attachment in accordance with the second trajectory; and the second trajectory is determined in part based on a detected height of the loading area and/or a detected profile of material previously loaded in the loading area.

* * * * *